US008544563B2

(12) United States Patent
Bourne et al.

(10) Patent No.: US 8,544,563 B2
(45) Date of Patent: Oct. 1, 2013

(54) OIL WELL PERFORATORS

(75) Inventors: Brian Bourne, Sevenoaks (GB); Nathan G Clark, Mansfield, TX (US)

(73) Assignee: Qinetiq Limited, London (GB)

( * ) Notice: Subject to any disclaimer, the term of this patent is extended or adjusted under 35 U.S.C. 154(b) by 402 days.

(21) Appl. No.: 12/527,261

(22) PCT Filed: Feb. 18, 2008

(86) PCT No.: PCT/GB2008/000546

§ 371 (c)(1),
(2), (4) Date: Sep. 14, 2009

(87) PCT Pub. No.: WO2008/102110

PCT Pub. Date: Aug. 28, 2008

(65) Prior Publication Data

US 2010/0096136 A1 Apr. 22, 2010

(30) Foreign Application Priority Data

Feb. 20, 2007 (GB) ..... 0703244.4

(51) Int. Cl.
*E21B 43/11* (2006.01)

(52) U.S. Cl.
USPC ..... 175/4.6; 166/297

(58) Field of Classification Search
USPC ..... 175/4.6; 166/297, 55.1; 102/476
See application file for complete search history.

(56) References Cited

U.S. PATENT DOCUMENTS

| | | | | |
|---|---|---|---|---|
| 2,972,948 | A | 2/1961 | Kray | |
| 3,235,005 | A | 2/1966 | Delacour | |
| 3,675,575 | A | 7/1972 | Bailey et al. | |
| 5,212,343 | A | 5/1993 | Brupbacher et al. | |
| 6,083,615 | A | 7/2000 | Long et al. | |
| 6,371,219 | B1 | 4/2002 | Collins et al. | |
| 6,494,139 | B1 | 12/2002 | Powell | |
| 7,278,353 | B2 | 10/2007 | Langan et al. | |
| 7,278,354 | B1 | 10/2007 | Langan et al. | |
| 8,220,394 | B2 * | 7/2012 | Bates et al. | 102/476 |
| 2002/0112564 | A1 | 8/2002 | Leidel et al. | |
| 2003/0037692 | A1 | 2/2003 | Liu | |
| 2003/0037693 | A1 | 2/2003 | Wendt et al. | |
| 2005/0011395 | A1 * | 1/2005 | Langan et al. | 102/476 |
| 2006/0266551 | A1 * | 11/2006 | Yang et al. | 175/4.6 |

FOREIGN PATENT DOCUMENTS

| | | |
|---|---|---|
| DE | 2 306 872 | 8/1974 |
| EP | 1 348 683 | 10/2003 |
| GB | 839872 | 6/1960 |
| GB | 2 295 664 | 6/1996 |
| WO | WO 2005/035939 | 4/2005 |

OTHER PUBLICATIONS

Communication pursuant to Rule 114(2) EPC dated Oct. 6, 2009 re: third party observation; 4 page letter of Liqine Liu.

(Continued)

*Primary Examiner* — William P Neuder
(74) *Attorney, Agent, or Firm* — Nixon & Vanderhye P.C.

(57) ABSTRACT

An oil and gas well shaped charge perforator capable of providing an exothermic reaction after detonation is provided, having a housing, a high explosive, and a reactive liner where the high explosive is positioned between the reactive liner and the housing. The reactive liner is produced from a composition which is capable of sustaining an exothermic reaction during the formation of the cutting jet.

34 Claims, 1 Drawing Sheet

(56) References Cited

OTHER PUBLICATIONS

SAND 95-2448C, S.H. Fisher & M.C. Grubelich, 1966; A Survey of Combustible Metals, Thermites, and Intermetallics for Pyrotechnic Applications by Fischer et al, pp. 1 and 9.
International Search Report for PCT/GB2008/000546, mailed Jun. 24, 2008.
Written Opinion of the International Searching Authority for PCT/GB2008/000546, mailed Jun. 24, 2008.
UK Search Report for GB Application No. 0703244.4, dated Jun. 4, 2007.
S.H. Fisher & M.C. Grubelich, A Survey of Combustible Metals, Thermites, and Intermetallics for Pyrotechnic Applications, SAND 95-2448C, 1966, pp. 1-13.

* cited by examiner

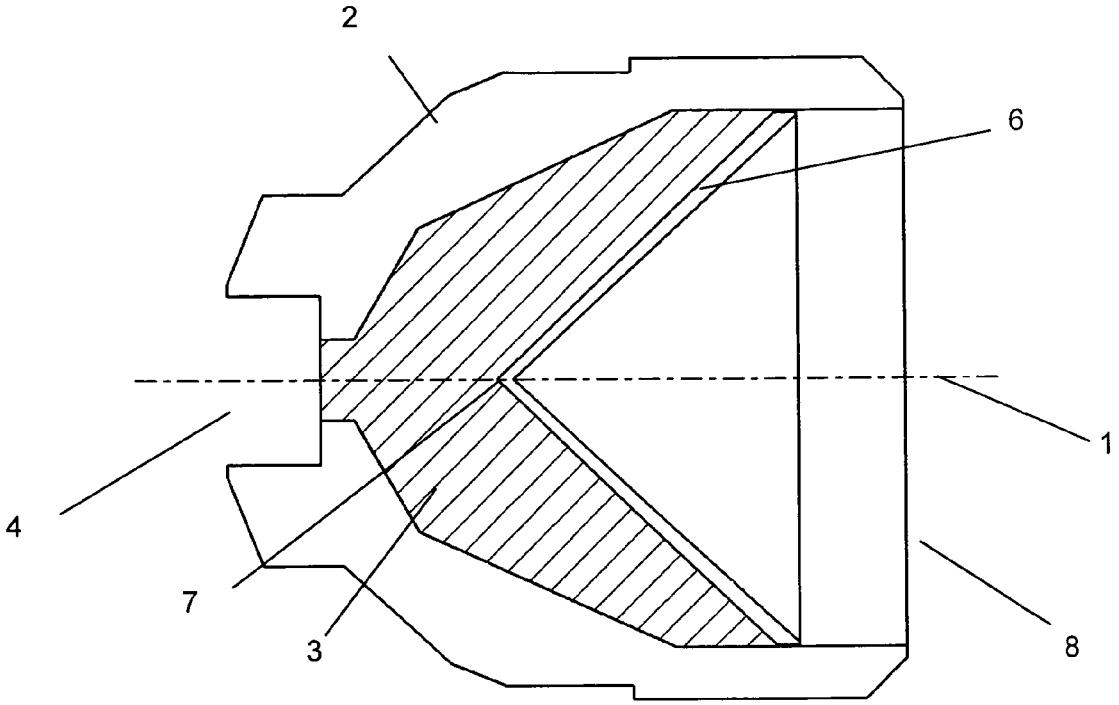
2
6
1
4
7
3
8

OIL WELL PERFORATORS

This application is the U.S. national phase of International Application No. PCT/GB2008/000546 filed 18 Feb. 2008 which designated the U.S. and claims priority to United Kingdom Application No. GB 0703244.4 filed 20 Feb. 2007; the entire contents of each of which are hereby incorporated by reference.

The present invention relates to a reactive shaped charge liner for a perforator for use in perforating and fracturing subterranean well completions, perforators and perforation guns comprising said liners and methods of using such apparatus.

By far the most significant process in carrying out a well completion in a cased well is that of providing a flow path between the production zone, also known as a formation, and the well bore. Typically, the provision of such a flow path is carried out by using a perforator, initially creating an aperture in the casing and then penetrating into the formation via a cementing layer, this process is commonly referred to as a perforation. Although mechanical perforating devices are known, almost overwhelmingly such perforations are formed using energetic materials, due to their ease and speed of use. Energetic materials can also confer additional benefits in that they may provide stimulation to the well in the sense that the shockwave passing into the formation can enhance the effectiveness of the perforation and produce an increased flow from the formation. Typically, such a perforator will take the form of a shaped charge. In the following, any reference to a perforator, unless otherwise qualified, should be taken to mean a shaped charge perforator.

A shaped charge is an energetic device made up of a housing within which is placed a typically metallic liner. The liner provides one internal surface of a void, the remaining surfaces being provided by the housing. The void is filled with an explosive, which when detonated, causes the liner material to collapse and be ejected from the casing in the form of a high velocity jet of material. This jet impacts upon the well casing creating an aperture, the jet then continues to penetrate into the formation itself, until the kinetic energy of the jet is overcome by the material in the formation. The liner may be hemispherical but in most perforators is generally conical. The liner and energetic material are usually encased in a metallic housing; conventionally the housing will be steel although other alloys may be preferred. In use, as has been mentioned the liner is ejected to form a very high velocity jet which has great penetrative power.

Generally, a large number of perforations are required in a particular region of the casing proximate to the formation. To this end, a so called gun is deployed into the casing by wireline, coiled tubing or indeed any other technique known to those skilled in the art. The gun is effectively a carrier for a plurality of perforators that may be of the same or differing output. The precise type of perforator, their number and the size of the gun are a matter generally decided upon by a well completion engineer based on an analysis and/or assessment of the characteristics of the well completion. Generally, the aim of the well completion engineer is to obtain an appropriate size of aperture in the casing together with the deepest and largest diameter hole possible in the surrounding formation. It will be appreciated that the nature of a formation may vary both from completion to completion and also within the extent of a particular well completion. In many cases fracturing of the perforated substrate is highly desirable.

Typically, the actual selection of the perforator charges, their number and arrangement within a gun and indeed the type of gun is decided upon by the completion engineer. In most cases this decision will be based on a semi-empirical approach born of experience and knowledge of the particular formation in which the well completion is taking place. However, to assist the engineer in his selection there have been developed a range of tests and procedures for the characterisation of an individual perforator's performance. These tests and procedures have been developed by the industry via the American Petroleum Institute (API). In this regard, the API standard RP 19B (formerly RP 43 5$^{th}$ Edition) currently available for download from www.api.orq is used widely by the perforator community as indication of perforator performance. Manufacturers of perforators typically utilise this API standard marketing their products. The completion engineer is therefore able to select between products of different manufacturers for a perforator having the performance he believes is required for the particular formation. In making his selection, the engineer can be confident of the type of performance that he might expect from the selected perforator.

Thus, in accordance with a first aspect of the invention, there is provided a reactive oil and gas well shaped charge perforator liner comprising a reactive composition comprising at least two metals that are capable of an exothermic reaction, wherein the liner further comprises at least one further metal, which is not capable of an exothermic reaction with the at least two metals and said further metal is present in an amount greater than 10% w/w of the liner.

According to a further aspect of the invention there is provided a reactive oil and gas well shaped charge perforator liner comprising a reactive composition capable of an exothermic reaction, wherein the liner further comprises at least one further metal selected from copper or tungsten or admixture thereof, wherein said further metal is present in an amount greater than 10% w/w of the liner. Preferably, the reactive composition comprises at least two metals that are capable of an exothermic reaction.

Preferably the composition comprising said at least two metals that are capable of an exothermic reaction are caused to react upon activation of an associated shaped charge.

The problem of additional energy can in part be overcome by using liners which undergo secondary reactions. However, the materials which are typically used in reactive liners may have significantly reduced penetrative depth due to their physical properties.

It is desirable to provide a shaped charge liner, which produces a shaped charge jet that provides additional energy in the form of heat after the initial detonative event of the shaped charge device. The heat energy, which arises from the reactive composition, is imparted to the rock strata of well completion, which causes increased fracturing and damage to said strata. The increased damage is caused by the action of the heat energy on the materials within the oil and gas well completion. The increased fracturing increases the total penetrative depth and volume available for oil and gas to flow out of the strata. Clearly the increase in depth and widths of the hole leads to larger hole volumes and a concomitant improvement in oil or gas flow, i.e. a bigger surface area of the hole volume from which the fluid may flow.

Preferably the further metal is present in an amount greater than 20% w/w of the liner, more preferably greater than 40% w/w of the liner. In a yet further preferred option the further metal is present in the range of from 40% to 95% w/w of the liner, more preferably in the range of from 40% to 80% w/w, yet more preferably 40% to 70% w/w of the liner. The percentage weight for weight w/w is with respect to the total composition of the liner.

Advantageously, it has been found that the inclusion of a further metal, preferably one which does not react with the reactive composition, particularly a high density metal, provides a fracture (tunnel) possessing unexpectedly large volume. The increase in volume is provided by an increase in the tunnel diameter, compared to the top perforating industry standard deep hole perforator (DP) perforator. It has been unexpectedly found that only low percentage amounts of the reactive composition material are required in combination with typical shaped charge liner material to afford very large increases in hole volume, whilst still maintaining the desired depth of perforated tunnel. It is unexpected that such significant increases in hole volume can be achieved using less than 50% w/w or, indeed, less than 30% w/w, or less than 20% w/w of reactive composition in a liner. Preferably the reactive composition is present in the range of from 1% w/w to 60% w/w, more preferably 5% w/w to 50% w/w, more preferably 5% w/w to 30% w/w. Preferably, the reactive composition and the at least one further metal together form substantially the balance of the liner.

The at least one further metal may be considered as being substantially non-reactive or substantially inert with respect to the reactive composition. By the term, not capable of an exothermic reaction, we mean that the further metal possess only a reduced energy of formation with any of the at least two metals, compared to the energy of formation between the at least two metals.

Reaction between the further metal and the at least two metals is likely to be less favourable, than the reaction between the at least two metals, and is therefore not likely to be the main product of such a reaction. Furthermore, it would be clear to the skilled man that although the reaction between the further metal and the at least two metals is less favourable, there may be a trace amount of such a reaction product observed upon detailed investigation.

Yet further advantage has unexpectedly been found at high percentage inclusion of the at least one further metal. The penetrative depth is at least equivalent and in most cases improved over existing top industry-standard DP perforators, which employ dense metal liners. As a result of increased tunnel depth and diameter, there is a dramatic increase in the total volume of the tunnel or fracture left in the rock strata.

The at least one further metal is preferably selected from a high density metal. Particularly suitable metals are copper, tungsten, an admixture or an alloy thereof. The further metal is preferably mixed and uniformly dispersed within the reactive composition to form an admixture. Alternatively the liner may be produced such that there are at least two layers, thereby providing a layer of inert metal covered by a layer of the reactive liner composition which can then be pressed to form a consolidated liner by any known pressing techniques.

In order to achieve this exothermic output the liner composition preferably comprises at least two metal components which, when supplied with sufficient energy (i.e. an amount of energy in excess of the activation energy of the exothermic reaction) will react to produce a large amount of energy, typically in the form of heat. The energy to initiate the electron compound i.e. inter-metallic reaction is supplied by the detonation of the high explosive in the shaped charge device.

In an another embodiment, the liner composition may further comprise at least one non-metal, where the non-metal may be selected from a metal oxide, such as tungsten oxide, copper oxide, molybdenum oxide or nickel oxide or any non-metal from Group III or Group IV, such as silicon, boron or carbon. Pyrotechnic formulations involving the combustion of reaction mixtures of fuels and oxidisers are well known. However a large number of such compositions, such as gunpowder for example, would not provide a suitable liner material, as they may not possess the required density or mechanical strength. Below is a non-exhaustive list of elements that when combined and subjected to a stimulus such as heat or an electrical spark produce an exothermic reaction and which may be selected for use in a reactive liner:

Al and one of Li or S or Ta or Zr
B and one of Li or Nb or Ti
Ce and one of Zn or Mg or Pb
Cu and S
Fe and S
Mg and one of S or Se or Te
Mn and either S or Se
Ni and one of Al or S or Se or Si
Nb and B
Mo and S
Pd and Al
Ta and one of B or C or Si
Ti and one of Al or C or Si
Zn and one of S or Se or Te
Zr and either of B or C There are a number of reactive compositions which contain only metallic elements and also compositions which contain metallic and non metallic elements, that when mixed and heated or provided with a sufficient stimulus such as, for example, a shock wave to overcome the activation energy of the reaction, will produce a large amount of thermal energy as shown above and further will also provide a liner material of sufficient mechanical strength.

Preferably, the reactive composition may comprise at least two metals, which may be selected from Al, Ce, Fe, Co, Li, Mg, Mo, Ni, Nb, Pb, Pd, Ta, Ti, Zn or Zr, in combinations which are known to produce an exothermic event when mixed. Other metals or non-metals, or combinations would be readily appreciated by those skilled in the art of energetic formulations.

The use of non-stoichiometric amounts of the at least two metals will provide an exothermic reaction between the at least two metals. However, such a composition may not furnish the optimal amount of energy, in a preferred embodiment the exothermic reaction of the liner may preferably be achieved by using a typically stoichiometric (molar) mixture of the at least two metals. The at least two metals are selected such that they are capable upon activation of the shaped charge liner to produce an electron compound, which are often referred to as an intermetallic electron compound, and the release of heat and light. The reaction may involve only two metals, however intermetallic reactions involving more than two metals are known.

Conveniently, one of the at least two metals, which undergo the exothermic reaction, is from Group IIIB of the periodic classification. A particularly preferred example is aluminium.

The other metal, selected as the other metal of the at least two metals, may be selected from metals in any one of Groups VIIIA, VIIA, VIA, IIB and 1B of the periodic classification. Preferably the metal may be selected from Group VIIIA VIIA and IIB, more preferably Group VIIIA, such as, for example, iron, cobalt, nickel and palladium.

Preferably there is provided a reactive oil and gas well shaped charge perforator liner comprising a reactive composition comprising two metals that are capable of an exothermic reaction, the first metal being selected from Group IIIB and a second metal selected from any one of Groups VIIIA, VIIA and IIB, wherein the reactive composition further comprises at least one further metal, selected from copper or tungsten and is present in an amount in the range of from 40-80% w/w of the liner. There is provided a method of use of said reactive oil and gas well shaped charge perforator liner.

There is provided a method of improving fluid outflow from an oil or gas well comprising the use of a reactive liner comprising a reactive composition capable of an exothermic reaction upon activation of the shaped charge liner, wherein the reactive composition further comprises at least one high density further metal, and the at least one further metal forming an admixture with the reactive composition, wherein the at least one further metal is present in an amount in the range of 40 to 80% w/w of the liner, said reactive liner being capable in operation, of providing thermal energy, by an exothermic reaction upon activation of an associated shaped charge, wherein said thermal energy is imparted to the saturated substrate of the well.

It has been shown using molecular modelling that the heats of formation with aluminium appear to maximise around nickel, cobalt and iron (Group VIIIA). Moving either side of this group to copper (Group 1B) and manganese (Group VIIA) reduces the values from about 3000 cal/cc to about 1400 cal/cc. The heats of formation then drop away to lower values for titanium and zirconium (Group IVA) with chromium (Group VIA) almost zero. Therefore Cu and W may be considered to be, not capable of an exothermic reaction with the at least two metals, in the reactive composition.

There are many different electron intermetallic compounds that may be formed. Conveniently, these compounds may be grouped as Hume-Rothery compounds. The Hume-Rothery classification identifies the intermetallic compound by means of its valence electron concentration. Preferably, the at least two metals may be selected to produce, in operation, intermetallic compounds which possess electron to atom ratios, such as, for example 3/2, 7/4, 9/4 and 21/13, preferably 3/2.

Advantageous exothermic energy outputs can be achieved with stoichiometric compositions of Co—Al, Fe—Al, Pd—Al and Ni—Al. The preferred at least two metals are nickel and aluminium or palladium and aluminium, mixed in stoichiometric quantities. The above examples, of the at least two metals when they are forced to undergo a reaction, provide excellent thermal output and in the case of nickel, iron and aluminium are relatively cheap materials.

The reactive liners give particularly effective results when the two metals are provided in respective proportions calculated to give an electron atom ratio 3/2 that is a ratio of 3 valency electrons to 2 atoms such as Ni—Al or Pd—Al as noted above.

By way of example an important feature of the invention is that Ni—Al reacts only when the mixture experiences a shock wave of >~14 Gpa. This causes the powders to form the intermetallic Ni—Al with a considerable out put of energy.

There are a number of intermetallic alloying reactions that are exothermic and find use in pyrotechnic applications. Thus the alloying reaction between aluminium and palladium releases 327 cals/g and the aluminium/nickel system, producing the compound Ni—Al, releases 329 cals/g (2290 cals/$cm^3$). For comparison, on detonation TNT gives a total energy release of about 2300 cals/$cm^3$ so the reaction is of similar energy density to the detonation of TNT, but of course with no gas release. The heat of formation is about 17000 cal/mol at 293 degrees Kelvin and is clearly due to the new bonds formed between two dissimilar metals.

In a conventional shaped charge energy is generated by the direct impact of the high kinetic energy of the jet. Whereas reactive jets comprise a source of additional heat energy, which is available to be imparted into the target substrate, causing more damage in the rock strata, compared with non-reactive jets. Rock strata are typically porous and comprise hydrocarbons (gas and liquids) and water, in said pores or. In shaped charges according to the invention, the fracturing is caused by direct impact of the jet and a heating effect from the exothermic reactive composition. This heating effect imparts further damage by physical means such as the rapid heating and concomitant expansion of the fluids present in the completion, thereby increasing the pressure of the fluids, causing the rock strata to crack. Furthermore, there may be some degree of chemical interaction between the reactive composition and the materials in the completion.

The Pd—Al system can be used simply by swaging palladium and aluminium together in wire or sheet form, but Al and Ni only react as a powder mixture.

Palladium, however, is a very expensive platinum group metal and therefore the nickel-aluminium has significant economic advantages. An empirical and theoretical study of the shock-induced chemical reaction of nickel and aluminium powder mixtures has shown that the threshold pressure for reaction is about 14 Gpa. This pressure is easily obtained in the shock wave of modern explosives used in shaped charge applications and so Ni—Al can be used as a shaped charge liner to give a reactive, high temperature jet. The jet temperature has been estimated to be 2200 degrees Kelvin. The effect of the particle sizes of the two component metals on the properties of the resultant shaped charge jet is an important feature to obtain the best performance. micron and nanometric size aluminium and nickel powders are both available commercially and their mixtures will undergo a rapid self-supporting exothermic reaction. A hot Ni—Al jet should be highly reactive to a range of target materials, hydrated silicates in particular should be attacked vigorously. Additionally, when dispersed after penetrating a target in air the jet should subsequently undergo exothermic combustion in the air so giving a blast enhancement.

For some materials like Pd—Al the desired reaction from the shaped charge liner may be obtained by forming the liner by cold rolling sheets of the separate materials to form the composition which can then be finished by any method including machining on a lathe. Pd—Al liners may also be prepared by pressing the composition to form a green compact In the case of Al—Ni the reaction will only occur if liner is formed from a mixture of powders that are green compacted. It will be obvious that any mechanical or thermal energy imparted to the reactive material during the formation of the liner must be taken into consideration so as to avoid an unwanted exothermic reaction. Preferably the liner is an admixture of particulates of the reactive composition and the at least one further metal, more preferably an admixture of the at least two metals and the at least one further metal, wherein the liner is formed by pressing the admixture of particulates, using known methods, to form a pressed i.e. consolidated liner.

In the case of pressing the reactive composition to form a green compacted liner a binder may be required, which can be a powdered soft metal or non-metal material. Preferably the binder comprises a polymeric material like PTFE or inorganic compound, such as a stearate, wax or epoxy resin. Alternatively the binder may be selected from an energetic binder such as Polyglyn (Glycidyl nitrate polymer), GAP (Glycidyl azide polymer) or Polynimmo (3-nitratomethyl-3-methyloxetane polymer). The binder may also be selected from a metal stearate, such as, for example, lithium stearate or zinc stearate.

Conveniently, at least one of the at least two metals or the further metal which forms part of the liner composition may be coated with one of the aforementioned binder materials. Typically the binder, whether it is being used to pre-coat a metal or is mixed directly into the composition containing a metal, may be present in the range of from 1% to 5% by mass.

When a particulate composition is to be used, the diameter of the particles, also referred to as 'powder grain size', or average particle size (APS), plays an important role in the energy output achievable and also consolidation of the material and therefore affects the pressed density of the liner. It is desirable that the grain size of the at least two metals and the further metal are similar in size to ensure homogenous mixing. It is desirable for the density of the liner to be as high as possible in order to produce a more effective hole forming jet. It is desirable that the diameter of the particles of the reactive composition is less than 50 μm, more preferably less than 25 μm, yet more preferably particles of 1 μm or less in diameter, and even nano scale particles may be used. Materials referred to herein with particulate sizes less than 1 μm are referred to as "nano-crystalline materials".

Advantageously, it has been found that at high percentages of tungsten, the at least two metals themselves provide the necessary lubricating properties to reduce the requirement of additional binders. Accordingly there is provided the use of the at least two metals as hereinbefore defined as a reactive binder for a consolidated particulate liner, such as for example a consolidated tungsten or copper particulate liner.

Advantageously, if the particle diameter size of the at least two metals (which undergo the intermetallic reaction), such as, for example, nickel and aluminium or iron and aluminium or palladium and aluminium in the composition of a reactive liner is less than 10 microns, and even more preferably less than 1 micron, the reactivity and hence the rate of exothermic reaction of the liner will be significantly increased, due to the large increase in surface area. Therefore, a reactive composition formed from readily available materials, such as those disclosed earlier, may provide a liner which possesses not only the kinetic energy of the cutting jet, as supplied by the explosive, but also the additional thermal energy from the exothermic chemical reaction of the composition.

At particle diameter sizes of less than 0.1 microns the at least two metals in the reactive composition become increasingly attractive as a shaped charge liner material due to their even further enhanced exothermic output on account of the extremely high relative surface area of the reactive compositions. A yet further advantage of decreasing particle diameter, is that as the particle size of the at least one further metal decreases the actual density that may be achieved upon consolidation increases. As particle size decreases, the actual consolidated density that can be achieved starts to approach the theoretical maximum density for the at least one further metal.

The reactive liner thickness may be selected from any known or commonly used wall liner geometries thickness. The liner wall thickness is generally expressed in relation to the diameter of the base of the liner and is preferably selected in the range of from 1 to 10% of the liner diameter, more preferably in the range of from 1 to 5% of the liner diameter. In one arrangement the liner may possess walls of tapered thickness, such that the thickness at the liner apex is reduced compared to the thickness at the base of the liner or alternatively the taper may be selected such that the apex of the liner is substantially thicker than the walls of the liner towards its base. A yet further alternative is where the thickness of the liner is not uniform across its surface area or cross section: for example a conical liner in cross section wherein the slant/slope comprises blended half angles scribed about the liner axis to produce a liner of variable thickness.

The shape of the liner may be selected from any known or commonly used shaped charge liner shape, such as substantially conical, tulip, trumpet or hemispherical.

In another aspect, the invention comprises a shaped charge suitable for down hole use, comprising a housing, a quantity of high explosive and a liner as described hereinbefore, located within the housing, the high explosive being positioned between the liner and the housing.

In use the reactive liner imparts additional thermal energy from the exothermic reaction, which may help to further distress and fracture the well completion. A yet further benefit is that the material of the reactive liner may be consumed such that there is no slug of liner material left in the hole that has just been formed, which can be the case with some non-reactive liners. The slug that is left behind, with non-reactive liners, may create a yet further obstruction to the flow of oil or gas from the well completion.

Preferably the housing is made from steel although the housing could be formed partially or wholly from one of the reactive liner compositions or preferably the at least two reactive metals, by one of the aforementioned pressing techniques, such that upon detonation the case may be consumed by the reaction to reduce the likelihood of the formation of fragments. If these fragments are not substantially retained by the confines of the perforating gun then they may cause a further obstruction to the flow of oil or gas from the well completion.

The high explosive may be selected from a range of high explosive products such as RDX, TNT, RDX/TNT, HMX, HMX/RDX, TATB, HNS. It will be readily appreciated that any suitable energetic material classified as a high explosive may be used in the invention. Some explosive types are however preferred for oil well perforators, because of the elevated temperatures experienced in the well bore.

The diameter of the liner at the widest point, that being the open end, can either be substantially the same diameter as the housing, such that it would be considered as a full calibre liner or alternatively the liner may be selected to be sub-calibre, such that the diameter of the liner is in the range of from 80% to 95% of the full diameter. In a typical conical shaped charge with a full calibre liner the explosive loading between the base of the liner and the housing is very small, such that in use the base of the cone will experience only a minimum amount of loading. Therefore in a sub calibre liner a greater mass of high explosive can be placed between the base of the liner and the housing to ensure that a greater proportion of the base liner is converted into the cutting jet.

The depth of penetration into the well completion is a critical factor in well completion engineering, and thus it is usually desirable to fire the perforators perpendicular to the casing to achieve the maximum penetration, and as highlighted in the prior art typically also perpendicular to each other to achieve the maximum depth per shot. It may be desirable to locate and align at least two of the perforators such that the cutting jets will converge, intersect or collide at or near the same point. In an alternative embodiment at least two perforators are located and aligned such that the cutting jets will converge, intersect or collide at or near the same point, wherein at least one perforator is a reactive perforator as hereinbefore defined. The phasing of perforators for a particular application is an important factor to be taken into account by the completion engineer.

The perforators as hereinbefore described may be inserted directly into any subterranean well completion, however it is usually desirable to incorporate the perforators into a perforation gun, in order to allow a plurality of perforators to be deployed into the well completion.

According to a further aspect of the invention there is provided a method of completing an oil or gas well using one or more shaped charge perforators, or one or more perforation guns as hereinbefore defined.

There is further provided a method of improving fluid inflow from an oil or gas well, comprising the use of a reactive liner which is capable, in operation, of providing thermal energy, by an exothermic reaction upon activation of an associated shaped charge, wherein said thermal energy is imparted to the saturated substrate of the well.

It will be understood by the skilled man that inflow is the flow of fluid, such as, for example, oil or gas, from a well completion.

Conveniently improvement of fluid inflow may be provided by the use of a reactive liner which reacts to produce a jet with a temperature in excess of 2000 K, such that in use said jet interacts with the saturated substrate of an oil or gas well, causing increased pressure in the progressively emerging perforator tunnel. In a preferred embodiment, the oil or gas well is completed under substantially neutral balanced conditions. This is particularly advantageous as many well completions are performed using under balanced conditions to remove the debris form the perforated holes. The generation of under balance in a well completion requires additional equipment and expense. Conveniently the improvement of inflow of the oil or gas well may be obtained by using one or more perforators or one or more perforation guns as hereinbefore defined.

Accordingly, there is further provided an oil and gas well perforation system intended for carrying out the method of improving inflow from a well comprising one or more perforation guns or one or more shaped charge perforators as hereinbefore defined.

According to a further aspect of the invention there is provided the use of a reactive liner or perforator as hereinbefore defined to increase fracturing in an oil or gas well completion for improving the inflow from said well.

A yet further aspect of the invention provides the use of a reactive liner or perforator or perforation gun as hereinbefore defined to reduce the debris in a perforation tunnel. The reduction of this type of debris is commonly referred to, in the art, as clean up.

According to a further aspect of the invention there is provided a method of improving inflow from a well comprising the step of perforating the well using at least one liner, perforator, or perforation gun according to the present invention. Inflow performance is improved by virtue of improved perforations created, that is larger diameter, greater surface area at the end of the perforation tunnel and cleaned up holes, holes essentially free of debris.

According to a yet further aspect of the invention, there is provided a reactive shaped charge liner, wherein the liner comprises a reactive composition capable of an exothermic reaction upon activation of the shaped charge liner, wherein the reactive composition further comprises at least one further metal, which is not capable of an exothermic reaction with the reactive composition and the at least one further metal forming an admixture with the reactive composition, wherein the at least one further metal is present in an amount greater than 10% w/w of the liner.

Preferably greater than 40% w/w, more preferably in the range of 40%-95% w/w, yet more preferably in the range of 40-70% of the liner Previously in the art, in order to create large diameter tunnels/fractures in the rock strata, big-hole perforators have been employed. The big-hole perforators are designed to provide a large hole, with a significant reduction in the depth of penetration into the strata. Typically, engineers have used combinations of big-hole perforators and standard perforators, to achieve the desired depth and volume. Alternatively tandem devices liners have been used which incorporate both a big-hole perforator and standard perforator. This typically results in less perforators per unit length in the perforation gun and may cause less inflow.

Advantageously, the reactive liners and perforators hereinbefore defined give rise to an increase in penetrative depth and volume, using only one shaped charge device. A further advantage is that the reactive liners according to the invention performs the dual action of depth and diameter (i.e. hole volume) and so there is no reduction in explosive loading or reduction in numbers of perforators per unit length.

In order to assist in understanding the invention, a number of embodiments thereof will now be described, by way of example only and with reference to the accompanying drawing, in which:

FIG. 1 is a cross-sectional view along a longitudinal axis of a shaped charge device in accordance with an embodiment of the invention containing a liner according to the invention.

As shown in FIG. 1 a cross section view of a shaped charge, typically axi-symmetric about centre line 1, of generally conventional configuration comprises a substantially cylindrical housing 2 produced from a metal (usually but not exclusively steel), polymeric, GRP or reactive material according to the invention. The liner 6 according to the invention, has a wall thickness of typically say 1 to 5% of the liner diameter but may be as much as 10% in extreme cases and to maximise performance is of variable liner thickness. The liner 6 fits closely in the open end 8 of the cylindrical housing 2. High explosive material 3 is located within the volume enclosed between the housing and the liner. The high explosive material 3 is initiated at the closed end of the device, proximate to the apex 7 of the liner, typically by a detonator or detonation transfer cord which is located in recess 4.

A suitable starting material for the liner comprises a Ni—Al—W, composition, containing 69.43 wt % tungsten, 9.6265 wt % aluminium and 20.9435 wt % nickel. This produces a stoichiometric Ni—Al mix. There was no additional powdered binder material added.

Other candidate compounds in this category may include, such as, for example, Co—Al, Fe—Al, Pd—Al, Cu—Zn, $Cu_3$—Al, and $Cu_5$—Sn.

The specific commercial choice of metals may also be influenced by cost and in that regard it is noted that both Ni and Fe from Group VIIIA of the periodic classification and Al from Group IIIB of the periodic classification are both inexpensive and readily available as compared with some other candidate metals. In tests it has been found that use of Ni—Al has given particularly good results. Furthermore, the manufacturing process for liners of Ni—Al is also relatively simple.

One method of manufacture of liners is by pressing a measure of intimately mixed and blended powders in a die set to produce the finished liner as a green compact. In other circumstances according to this patent, different, intimately mixed powders may be employed in exactly the same way as described above, but the green compacted product is a near net shape allowing some form of sintering or infiltration process to take place.

Modifications to the invention as specifically described will be apparent to those skilled in the art, and are to be considered as falling within the scope of the invention. For example, other methods of producing a fine grain liner will be suitable

EXAMPLES

A series of shaped charge liners were prepared with stoichiometric amounts of Ni and Al with varying amounts of tungsten being added. The liners were designed to fit to standard 3⅜ shaped charge housings. The explosive content, 25 grams was the same for all perforator designs. The shaped charges were fired into cylindrical sections of Berea stone, which is representative of the strata in oil and gas wells.

To mimic the conditions experienced down well, there was a quality control (QC) target placed in front of the perforator which comprises a ⅛" mild steel plate that represents the scallop which would normally be found in the perforation gun. Next to the QC target is ½' of water and ¼" mild steel plate. On the other side of the ¼" mild steel plate is the cylindrical sections of Berea stone. During testing the QC targets are standardised to the size of perforating gun being used.

The qualification tests were carried out under down simulated down hole conditions. using API RP 19B. Five inch Berea sandstone cores were used with an applied stress of 4000 psi. This test is advantageously used to quantify the hole morphology, total core penetration and flow characteristics of perforation holes Manufacturers of oil and gas well perforators typically utilise this and other API data in the marketing their products.

Gun swell tests using a 3⅜" reactive perforators as described showed the average swell was 3.590" representing a 6.37% increase in gun diameter, indicating a successful gun survival within industry limits after firing, the Berea stone samples were sectioned lengthways so the profile and dimensions of the tunnel created by the action of the liner could be examined. The results are shown in table 1 below.

The baseline liner is the current industry highest 3⅜" DP perforator, which comprises a mixture of tungsten, copper, lead, graphite and oil. From Table 1, the commercial liner provides a useful total core penetration length. However, one distinct disadvantage is that only 78% of the maximum tunnel depth is free of debris, this means that nearly one quarter of the tunnel created will not have maximum flow.

The reactive liners using Ni—Al and Mo—Al and Co—Al were previously developed to overcome the problem of excessive amounts of debris in the tunnel. The above table shows the results for shots 5, 6, 7, 8, and 13 reactive liners using only Ni—Al in stoichiometric amounts. The differences between these particular shots were initial attempts to optimise the liner profile whilst developing the near optimum pressing parameters. The above results show a clear and marked improvement in the percentage of the tunnel which is essentially free from debris, in the range of 92-100%. This is some 20 to 30%, on average, increase in useful or clear tunnel available for fluid flow from the well. A yet further advantage, is the significant increase, in excess of 150%, of the entrance tunnel diameter. The only drawback is that the hole depth, for 100% Ni—Al liners, is reduced compared to the commercial DP liner.

To improve the depth of penetration tungsten metal was added to the reactive Ni—Al. Although an increase in depth occurred, unexpectedly and advantageously the percentage of debris free volume available in the tunnel remained at a very high level, in fact in excess of 95%. It was very surprising to find that even at 70% inclusion of tungsten with Ni—Al only being present at 30% that nearly 100% of the tunnel created was usable. Furthermore and unexpectedly the 70% tungsten and 30% Ni—Al furnished a total tunnel depth (on average) in excess of the commercial DP liner. The 70% tungsten and 30% Ni—Al liner advantageously produced an entrance hole diameter which was approximately double the diameter and 4× the area, of the commercial DP liner.

TABLE 1 showing percentage inclusion of tungsten and tunnel profile.

| Powder Composition (weight) | Shot no. | % tungsten | Core Entrance hole diameter | CT Clear Tunnel | % CT | TCP Total Core Penetration |
|---|---|---|---|---|---|---|
| 21% Ni, 9% Al | 19, 20 | 70% W | 1.01 | 12.50 | 98% | 12.75 |
| 41% Ni, 19% Al | 16, 17 | 40% W | 1.20 | 9.21 | 96% | 9.55 |
| 62% Ni, 28% Al | 15 | 10% W | 1.22 | 8.75 | 98% | 8.90 |
| 68.5% Ni, 31.5% Al | 13 | 0% W | 1.27 | 5.35 | 100% | 5.35 |
| 68.5% Ni, 31.5% Al | 7, 8 | 0% W | 1.82 | 6.91 | 92% | 7.50 |
| 68.5% Ni, 31.5% Al | 5, 6 | 0% W | 1.30 | 7.89 | 100% | 7.89 |
| Cu, Pb, W Baseline | 1, 2, 4 | 0% W | 0.55 | 9.59 | 78% | 12.38 |

Table 1 shows the effect on perforation morphology for different compositions of nickel and aluminium with and without additions of tungsten. All the measurements are in inches. Total Core Penetration is the total length of the tunnel, which may have some debris. The CT value is clear tunnel i.e. the depth perforated which is clean of debris. Normally there is a fair amount of crushed zone which is sometimes cleaned up by under balance perforating. The percentage clear tunnel (% CT) is the amount of clear tunnel with respect to the Total Core Penetration (TCP) . . . . The entrance hole diameter is the diameter (inches) of the entrance hole into the Berea stone.

Where composition entries in Table 1 contain two or three firing results, the performance results are provided as the average of the obtained results.

Initial experiments were carried out to assess different intermetallic metal-metal combinations. The selection was based on heat of formation and relative costs of the starting materials, Ni—Al, Co—Al, Mo—$Ni_3$ had previously been identified as good candidate materials.

To measure the improvement, the total hole volume was measured for shot 20 and shot 1 and the results compared. The results are provided in table 2 below.

TABLE 2

Core hole measurements for baseline and reactive perforator.

| Shot no | Clear Tunnel (inches) | Surface Area ($inches^2$) | Volume ($inches^3$) |
|---|---|---|---|
| 1 (baseline) | 9.0 | 11.2 | 1.1 |
| 20(reactive) | 13.0 | 29.6 | 5.0 |
| % Increase | 44% | 164% | 351% |

As can be clearly seen from the results in Table 2, there is an extremely advantageous increase of over 350% in the debris-free total hole volume of 70% W-30% Ni—Al liner (shot 20) compared to the commercial DP liner, (shot 1). The depth of the tunnel, entrance hole diameter and total volume of the tunnel can be markedly increased whilst unexpectedly retaining the significant decrease in debris. This represents a very significant and unexpected advantage over the existing commercial DP liners. The increase in total hole volume and depth will therefore increase fluid inflow in oil and gas well completions. One particular advantage is that all of the reactive perforating jets achieved virtually 100% clean up in Berea sandstone and on visual inspection none of the hole surfaces showed any signs of glazing which might otherwise impede oil or gas flow.

There are many other possible interactions that may occur between the reactive composition of the liner according to the invention and the Berea sandstone or other rock strata formations. The high temperature of the reactive jet (2137K) means that heat can be transferred to the target material and this increase of temperature within the target material would reduce the rocks strata's strength due to thermal softening effects. The higher temperatures within the rock strata, as caused by the exothermic reaction from the reactive composition in the jet, would contribute to the many possible damage processes such as, for example, pore dilation, material strength depletion and material failure. These may occur as a consequence of a sudden and large temperature increases and concomitant pressure increases within the rock strata. The increased damages can improve the flow rate of the hydrocarbons from the well completion.

It is likely that the physical heating effects or, indeed, chemical reactions caused by the exothermic reaction of reactive composition, which arise within the rock strata is likely to occur after the initial kinetic energy penetration process. The reactive composition assists in the improved clean up observed in the perforation holes.

The invention claimed is:

1. A reactive oil and gas well shaped charge perforator liner comprising a reactive composition comprising at least two metals that are capable of an exothermic reaction, wherein the liner further comprises at least one further metal, which is not capable of an exothermic reaction with the at least two metals and said further metal is present in an amount greater than 40% w/w of the liner.

2. A liner according to claim 1, wherein the at least one further metal is selected from copper, tungsten, an admixture or an alloy thereof.

3. A liner according to claim 1 in which one of the at least two metals is from Group IIIB of the periodic classification.

4. A liner according to claim 3 wherein one of the at least two metals is aluminium.

5. A liner according to claim 1 in which one of the at least two metals is selected from Group VIIIA, VIIA, and IIB of the periodic classification.

6. A liner according to claim 5 wherein the metal is selected from iron, cobalt, nickel and palladium.

7. A liner according to claim 1 wherein the at least two metals are nickel and aluminium.

8. A liner according to claim 1 wherein the reactive composition is a stoichiometric composition of two metals.

9. A liner according to claim 1 wherein the at least two metals and the at least one further metal are uniformly dispersed to form an admixture.

10. A liner according to claim 1 wherein the liner is a pressed particulate composition.

11. A liner according to claim 10, wherein a binder is added to aid consolidation.

12. A liner according to claim 10, wherein at least one of the metals is coated with a binder to aid consolidation.

13. A liner according to claim 11, wherein the binder is an inorganic compound or polymer.

14. A liner according claim 13, wherein the binder is selected from a stearate, wax, perfluorinated polymer, epoxy resin lithium stearate or zinc stearate.

15. A liner according to claim 13, wherein the polymer is an energetic polymer.

16. A liner according to claim 11, wherein the binder is present in the range of from 0.1 to 5% by mass.

17. A liner according to claim 1, wherein the liner composition is particulate, the particles having a diameter 25 μm or less.

18. A liner according to claim 17, wherein the particles are 1 μm or less in diameter.

19. A liner according to claim 1 wherein the reactive composition is present in the range of from 5% w/w to 50% w/w.

20. An oil and gas well shaped charge perforator comprising a liner according to claim 1.

21. A perforation gun comprising one or more perforators according to claim 20.

22. A method of completing an oil or gas well using one or more shaped charge liners according to claim 1.

23. A method of completing an oil or gas well using a one or more shaped charge perforators, according to claim 20.

24. A method of completing an oil or gas well using one or more perforation guns according to claim 21.

25. A method according to claim 23 wherein at least two of the perforators are aligned such that the cutting jets will converge, intersect or collide.

26. A method of improving fluid outflow from an oil or gas well comprising the use of a reactive liner according to claim 1.

27. A method according to claim 26, wherein the oil or gas well is completed under substantially neutral conditions.

28. A method of increasing the fracturing in an oil or gas well for improving the fluid flow from said well comprising the step of detonating at least one reactive liner according to claim 1.

29. A method of improve the clean up of the perforation tunnel, comprising the step of using one or more reactive liners according to claim 1.

30. A liner according to claim 1, wherein the at least two metals capable of an exothermic reaction are nickel and aluminium and wherein the further metal is tungsten present in an amount of about 70% w/w of the liner.

31. A method of improving fluid outflow from an oil or gas well comprising the use of a reactive liner comprising a reactive composition capable of an exothermic reaction upon activation of the shaped charge liner, wherein the reactive composition further comprises at least one high density further metal, and the at least one further metal forming an admixture with the reactive composition, wherein the at least one further metal is present in an amount greater than 40% w/w of the liner, said reactive liner being capable in operation, of providing thermal energy, by an exothermic reaction upon activation of an associated shaped charge, wherein said thermal energy is imparted to the saturated substrate of the well.

32. A method of according to claim 31, comprising the use of a reactive liner which reacts to produce a jet with a temperature in excess of 2000 K, such that in use said jet interacts with the saturated substrate of an oil or gas well, causing increased pressure in the progressively emerging perforator tunnel.

33. A method according to claim 31 wherein the reactive composition comprises at least two metals capable, in operation, of an exothermic reaction upon activation of an associated shaped charge.

34. A method of improving fluid outflow from an oil or gas well comprising the use of shaped charge perforator liner comprising a reactive composition comprising two metals that are capable of an exothermic reaction, the first metal being selected from Group IIIB and a second metal selected from any one of Groups VIIIA, VIIA and IIB, wherein the reactive composition further comprises at least one further metal, selected from copper or tungsten or mixture thereof and is present in an amount greater than 40% w/w of the liner.

* * * * *